US010748493B2

(12) United States Patent
Park

(10) Patent No.: US 10,748,493 B2
(45) Date of Patent: Aug. 18, 2020

(54) DISPLAY DEVICE FOR DRIVING AND COMPENSATING LOW LATENCY VIRTUAL REALITY

(71) Applicant: LG Display Co., Ltd., Seoul (KR)

(72) Inventor: Dongwon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 22 days.

(21) Appl. No.: 16/219,385

(22) Filed: Dec. 13, 2018

(65) Prior Publication Data

US 2019/0206332 A1 Jul. 4, 2019

(30) Foreign Application Priority Data

Dec. 29, 2017 (KR) ..... 10-2017-0183566

(51) Int. Cl.
*G09G 3/3275* (2016.01)
*G09G 3/36* (2006.01)

(52) U.S. Cl.
CPC ..... *G09G 3/3275* (2013.01); *G09G 3/3685* (2013.01); *G09G 2310/08* (2013.01); *G09G 2320/0223* (2013.01); *G09G 2320/0261* (2013.01); *G09G 2320/0626* (2013.01); *G09G 2370/14* (2013.01)

(58) Field of Classification Search
CPC ..... G09G 3/3275; G09G 3/20; G09G 3/3685; G09G 3/2074; G09G 2370/14; G09G 2320/0626; G09G 2330/021; G09G 2320/0223; G09G 2310/08; G09G 2320/0261; G09G 2310/0267; G09G 2310/062; G09G 3/3266; G09G 3/3677; G09G 3/2092; G09G 3/3208; G09G 3/3611; G06F 3/011
See application file for complete search history.

(56) References Cited

U.S. PATENT DOCUMENTS

2007/0152996 A1* 7/2007 Shen ..... G09G 5/008 345/213
2010/0091000 A1* 4/2010 Lee ..... G09G 3/3696 345/208
2012/0256903 A1* 10/2012 Kim ..... H04N 13/398 345/419
2017/0155885 A1* 6/2017 Selstad ..... H04N 13/344

* cited by examiner

*Primary Examiner* — Jonathan A Boyd
(74) *Attorney, Agent, or Firm* — Fenwick & West LLP

(57) ABSTRACT

The present disclosure relates to a display device for driving virtual reality with low latency and compensating the reduced brightness. According to the present disclosure, a display device is provided, and the display device includes a timing controller for receiving a data signal and a timing signal from a host system, a data driving unit for receiving a drive signal from the timing controller, a gate driving unit for receiving a drive signal from the timing controller, a display panel having a plurality of sub-pixels and for displaying a video based on the signals received from the data driving unit and the gate driving unit, and a power supply unit for supplying power to the data driving unit, the gate driving unit, and the display panel; and the timing controller receives an address reset signal from the host system.

13 Claims, 11 Drawing Sheets

T_frame = 8.33 ms
T_addr = 6.66 ms
T_emit = 1.37 ms
T_extra = 3.33 ms
SECTION (1)(Ideal) = T_emit1 + T_addr2 = 8.33 ms, L_ideal = 0.2 (20%)
SECTION (2)(Actual) = T_emit1 + T_extra + T_addr3 = 11.66 ms, L_actual = 0.143 (14.3%)

L_ideal = 0.2 (20%)

L_actual = 0.14. (14.3%)

$$\text{Compensation Ratio} = \frac{\text{L_actual}}{\text{L_ideal}} = \frac{0.143}{0.2} = 0.715$$

DISPLAY DEVICE FOR DRIVING AND COMPENSATING LOW LATENCY VIRTUAL REALITY

CROSS-REFERENCE TO RELATED APPLICATIONS

This application claims priority to Republic of Korea Patent Application No. 10-2017-0183566 filed on Dec. 29, 2017 with the Korean Intellectual Property office, which is incorporated herein by reference in its entirety.

BACKGROUND

Field of Technology

The present disclosure relates to a display device for driving and compensating virtual reality, and more particularly, to a display device for driving virtual reality with a low latency and compensating reduced brightness.

Description of the Related Art

As the information technology is developed, the market of a display device that is a connection medium between a user and information is increasing. Accordingly, the use of a display device such as an organic light emitting diode (OLED) display device, a quantum dot display (ODD), a liquid crystal display (LCD), and a plasma display panel (PDP) is increasing.

The display device is implemented as a small, medium, or large-sized display such as a television, a set-top box, a navigation, a video player, a blu-ray player, a personal computer, a wearable device, a mobile phone, and a virtual reality display.

Meanwhile, the virtual reality display device can immerse the user in an environment that imitates and reproduces the reality as it is. For this purpose, the user of the virtual reality display device wears equipment, such as a goggle, a headset, a glove and special clothing, for exchanging information and is exposed to a virtual environment created by a system (e.g., a computer, etc.).

However, there is a problem in that the user experiences a so-called virtual reality sickness (VR Sickness) in viewing the virtual reality display device. The virtual reality is located closer to the eyeball of the human body than the general display device, such that the degree of visual acceptance of the screen by a human becomes very large. When the human motion is inconsistent with the change in the screen corresponding to the motion, the virtual reality sickness occurs. There is a problem in that the virtual reality sickness is a major discomfort for a virtual reality user and restricts the use time of virtual reality.

SUMMARY

The present disclosure is intended to solve the problems, and an object of the present disclosure is to provide a display device for driving a low latency virtual reality.

In addition, the present disclosure is intended to solve the problems, and another object of the present disclosure is to provide a display device for compensating brightness while driving low latency virtual reality.

According to the present disclosure, a display device is provided, and the display device includes a timing controller for receiving a data signal and a timing signal from a host system, a data driving unit for receiving a drive signal from the timing controller, a gate driving unit for receiving a drive signal from the timing controller, a display panel having a plurality of sub-pixels and for displaying a video based on the signals received from the data driving unit and the gate driving unit, and a power supply unit for supplying power to the data driving unit, the gate driving unit, and the display panel; and the timing controller receives an address reset signal from the host system.

The timing controller receives the address reset signal when motion occurs.

The timing controller transmits a gate reset signal to the gate driving unit when receiving the address reset signal.

An address reset bit is assigned to any one don't care bit of the don't care bits of a low voltage differential signaling (LVDS) transmission format communicated between the host system and the timing controller.

The address reset signal is received referring to a recovery table indicating a combination of a VSYNC bit and a HSYNC bit of a low voltage differential signaling (LVDS) transmission format communicated between the host system and the timing controller.

In a clock embedded interface between the host system and the timing controller, a first horizontal blank packet having an address reset start data, a dummy packet after the first horizontal blank packet, and a second horizontal blank packet having an address reset end data after the dummy packet are transmitted/received.

The display device adjusts the pulse of the address reset signal by adjusting the length of the dummy packet.

The timing controller transmits a compensation light-emission signal to the gate driving unit.

The compensation light-emission by the compensation light-emission signal in the display device is controlled by a light-emission period, and the light-emission period is controlled by the pulse width of the address reset signal.

The compensation light-emission by the compensation light-emission signal in the display device is controlled by light-emission brightness.

The gate driving unit performs a control of reducing the light-emission brightness for displaying video data reflecting motion.

The reduced light-emission brightness in the display device is calculated depending upon a compensation ratio; and the compensation rate is calculated at a ratio between ideal brightness and actual brightness.

According to the present disclosure, it is possible to achieve a low latency in driving the virtual reality.

In addition, in accordance with the present disclosure, it is possible to remove virtual reality sickness (VR Sickness) of a virtual reality user.

In addition, in accordance with the present disclosure, it is possible to compensate the decrease in brightness as the emission maintenance time of the previous frame becomes longer due to the gate addressing reset and the new frame configuration in response to the change in the user motion.

DETAILED DESCRIPTION

Hereinafter, embodiments of the present disclosure will be described with reference to the accompanying drawings.

Figure 1:
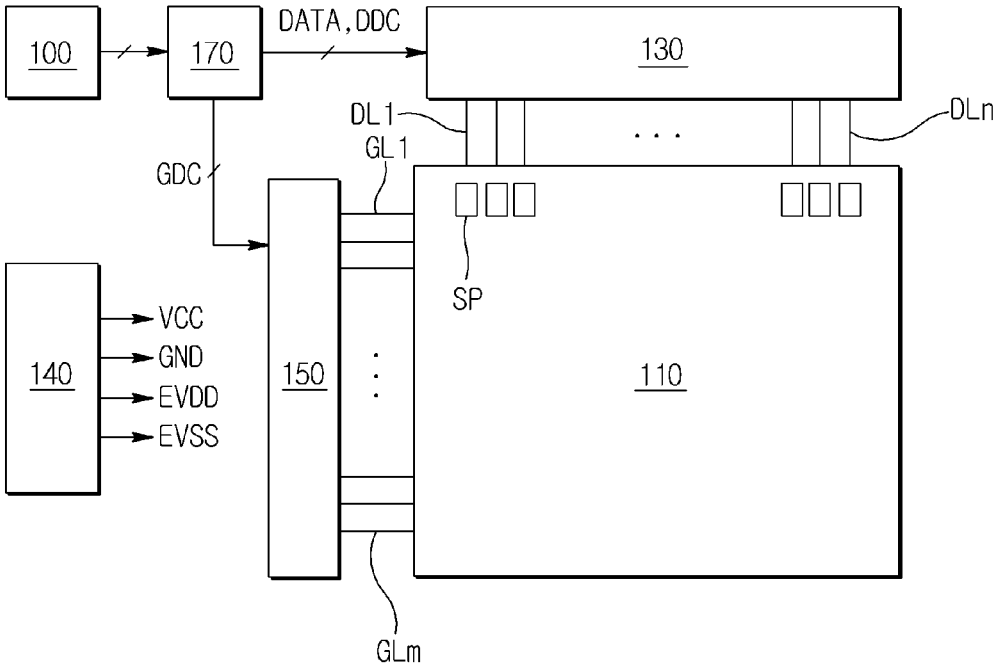
FIG. 1 is a block diagram schematically illustrating a display device in accordance with an embodiment of the present disclosure.

FIG. 1 is a block diagram schematically illustrating a display device in accordance with an embodiment of the present disclosure.

Figure 2:
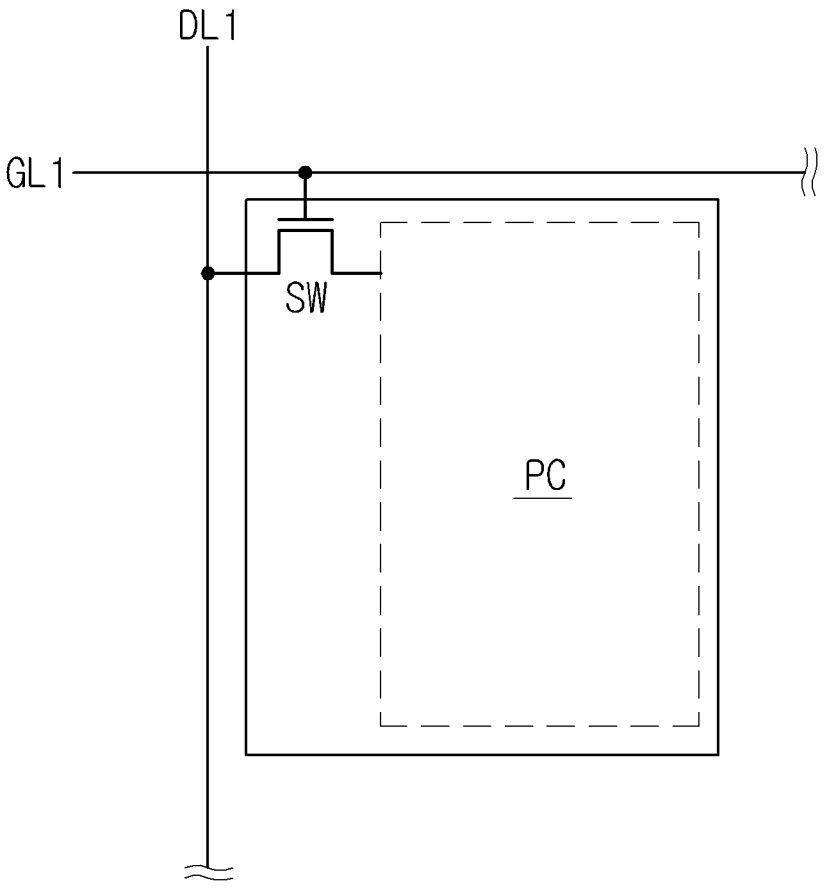
FIG. 2 is a configuration diagram schematically illustrating a sub-pixel of the display device illustrated in FIG. 1 in accordance with an embodiment of the present disclosure.

FIG. 2 is a configuration diagram schematically illustrating a sub-pixel of the display device illustrated in FIG. 1.

As illustrated in FIG. 1, the display device includes a host system 100, a timing controller 170, a data driving unit 130, a power supply unit 140, a gate driving unit 150, and a display panel 110.

The host system 100 includes a system on chip (SoC) in which a scaler is built-in, and converts the digital video data of the input video into data signals of a format suitable for displaying on the display panel 110 and outputs them. The host system 100 provides various timing signals to the timing controller 170 together with the data signals.

The timing controller 170 receives video data (Video Data) from the host system 100. The timing controller 170 controls the operation timing of the data driving unit 130 and the gate driving unit 150 based on timing signals such as a vertical sync signal (V_Sync), a horizontal sync signal (H_Sync), a data enable signal (DE), and a main clock signal (Pixel Clock) input from the host system 100.

The timing controller 170 processes as a video the data signal input from the host system 100 and supplies it to the data driving unit 130. For example, the timing controller 170 compensates the data signal input from the host system 100 and supplies it to the data driving unit 130.

The data driving unit 130 performs an operation in response to a signal supplied from the timing controller 170. For example, the data driving unit 130 operates in response to a first drive signal (DDC) provided from the timing controller 170. The data driving unit 130 converts the digital data signal (DATA) provided from the timing controller 170 into an analog data signal and outputs it.

Specifically, the data driving unit 130 converts the digital data signal (DATA) into the analog data signal in response to the gamma voltage of a gamma unit provided internally or externally. The data driving unit 130 provides the data signal to the data lines (DL1 to DLn) of the display panel 110.

The gate driving unit 150 performs an operation in response to a signal supplied from the timing controller 170. For example, the gate driving unit 150 operates in response to a second drive signal (GDC) provided from the timing controller 170. The gate driving unit 150 outputs a gate signal of a gate high voltage or a gate low voltage. The gate signal can be also referred to as a scan signal.

The gate driving unit 150 can sequentially output the gate signal in the forward direction or sequentially output it in the reverse direction. In addition, the gate driving unit 150 can simultaneously output the gate signal. The gate driving unit 150 provides the gate signal to the gate lines (GL1 to GLm) of the display panel 110.

The power supply unit 140 outputs a first voltage source (VCC, GND) for driving the data driving unit 130, etc. and a second voltage source (EVDD, EVSS) for driving the display panel 110. In addition, the power supply unit 140 generates a voltage required for driving the display device, such as the gate high voltage or the gate low voltage to be delivered to the gate driving unit 150.

The display panel 110 includes a plurality of sub-pixels (SP), the data lines (DL1 to DLn) connected to the sub-pixels (SP), and the gate lines (GL1 to GLm) connected to the sub-pixels (SP). The display panel 110 displays a video in response to the gate signal output from the gate driving unit 150 and the data signal output from the data driving unit 130. The display panel 110 includes a lower substrate and an upper substrate. The sub-pixels (SP) can be interposed between the lower substrate and the upper substrate.

As illustrated in FIG. 2, one sub-pixel includes a switching thin film transistor (SW) connected (or formed at the intersection) to the gate line (GL1) and the data line (DL1), and a pixel circuit (PC) operating in response to the data signal supplied through the switching thin film transistor (SW).

The display panel 110 can be implemented as a liquid crystal display panel or an organic light emitting display panel, etc. according to the configuration of the pixel circuit (PC) of the sub-pixels (SP). For example, when the display panel 110 is implemented as a liquid crystal display panel, it is operated in a twisted nematic (TN) mode, a vertical alignment (VA) mode, an in plane switching (IPS) mode, a fringe field switching (FFS) mode, or an electrically controlled birefringence (ECB) mode.

For another example, when the display panel 110 is implemented as an organic light emitting display panel, it operates in a top-emission mode or a bottom-emission mode.

The display panel of the display device described above can be selected from a liquid crystal display panel, an organic light emitting display panel, an electrophoretic display panel, a plasma display panel, etc. However, it should be understood that the present disclosure is not limited to any one of them.

In addition, the above-described display device can be implemented as a small, medium or large-sized display, such as a television, a set-top box, a navigation, a video player, a Blu-ray player, a personal computer, a wearable device, a home theater, a mobile phone, and a virtual reality (VR) display device. The display device described below has a greater advantage when implementing the virtual reality based on the display device having an organic light emitting display panel, and this will be described as an example. However, it should be understood that the present disclosure is not limited to any one of them.

In addition, in the display panel implementing the virtual reality, it can be implemented by any one of a rolling shutter mode and a global shutter mode. The display device described below has a greater advantage when implemented in the global shutter mode, and this will be described as an example. However, it should be understood that the present disclosure is not limited to any one of them.

Figure 3:
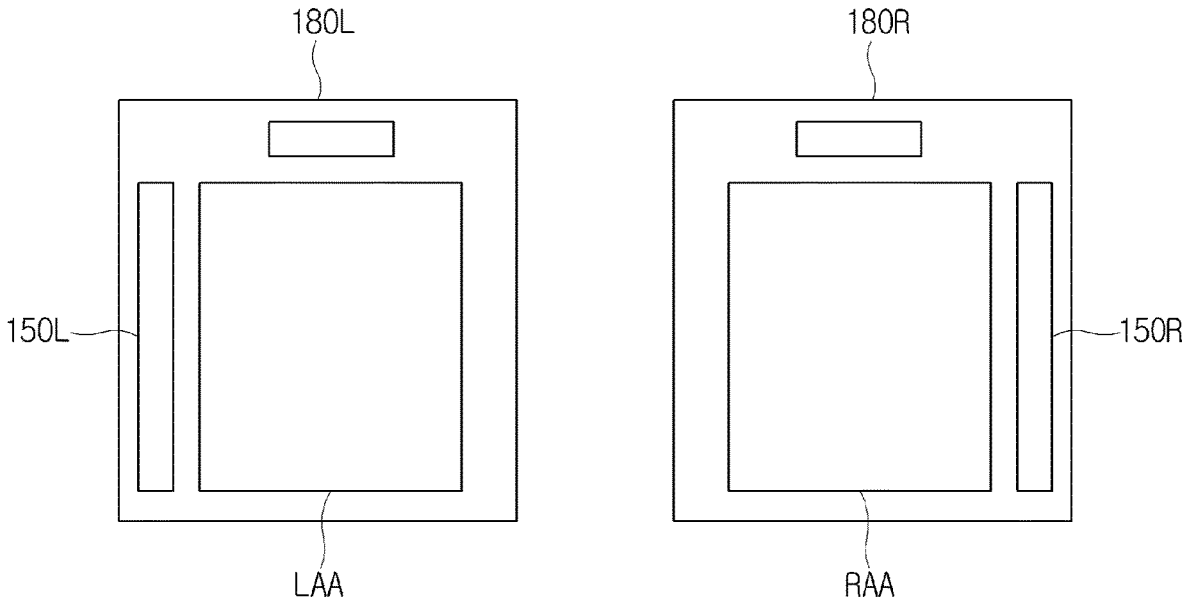
FIG. 3 is a diagram illustrating a part of a virtual reality display device in accordance with an embodiment of the present disclosure.

FIG. 3 is a diagram illustrating a part of a virtual reality display device.

As illustrated in FIG. 3, the virtual reality display device includes left eye display driving units (180L, 150L, LAA) for displaying videos in the left eye direction, and right eye display driving units (180R, 150R, RAA) for displaying videos in the right eye direction.

The left eye display driving units (180L, 150L, LAA) and the right eye display driving units (180R, 150R, RAA) include panel driving units (180L, 180R), gate driving units (150L, 150R), and display units (LAA and RAA).

The panel driving units (180L, 180R) control the gate driving units (150L, 150R) and supply the data signal to the display units (LAA, RAA). The panel driving units (180L, 180R) are an Integrated Circuit (IC) in which the timing controller 170 and the data driving unit 130 in FIG. 1 are integrated. The panel driving units (180L, 180R) can further include the power supply unit 140 in FIG. 1.

Meanwhile, FIG. 3 illustrates as an example that the left eye display driving units (180L, 150L, LAA) for displaying videos in the left eye display direction and the right eye display driving units (180R, 150R, RAA) for displaying videos in the right eye direction are separated, but it should be understood that it is merely one example and is not limited thereto.

The virtual reality display device as described above can immerse the user in an environment imitating and reproducing the reality as it is. For this purpose, the user wears equipment, such as a goggle, a headset, a glove, and special clothing, for exchanging information, and is exposed to the virtual environment created by a system (e.g., a computer, etc.).

Hereinafter, in order to improve virtual reality sickness (VR sickness) occurring in the virtual reality display device, a display device for driving and compensating virtual reality with low latency will be described.

Figure 4:
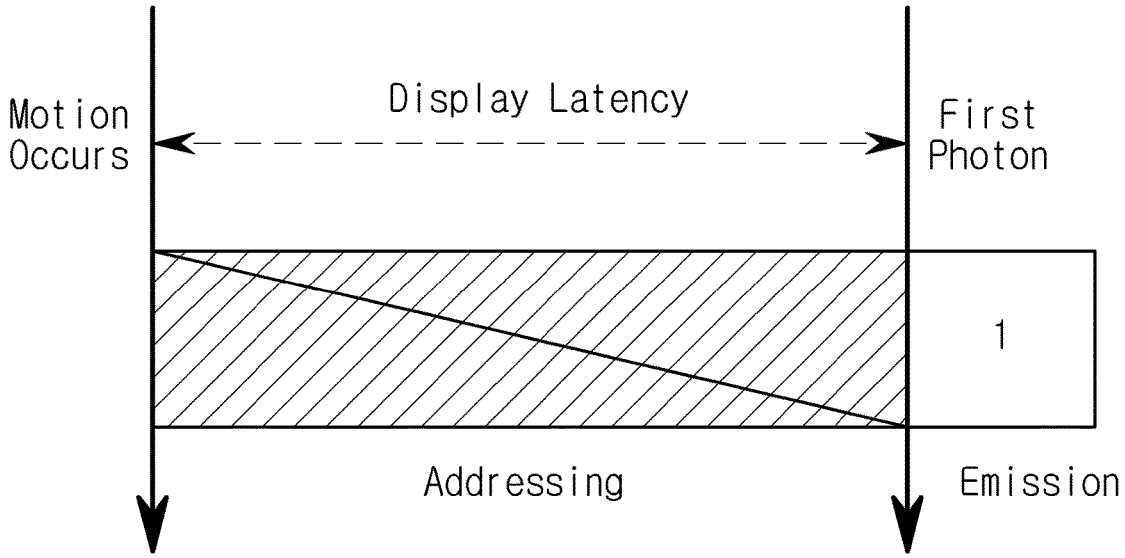
FIG. 4 is a diagram for explaining the definition of latency in the virtual reality display device in accordance with an embodiment of the present disclosure.

FIG. 4 is a diagram for explaining the definition of latency in the virtual reality display device.

Referring to FIG. 4, the latency in the virtual reality display device is defined as a period from the timing when motion occurs to the timing when a first photon is generated. Specifically, the motion refers to the change in the video displayed to a user. For example, when the user who experiences the virtual reality turns his/her head, this means the change in vision. Since the display should display an omnidirectional view in a physically restricted environment, the display device should display the changed vision on the panel depending upon the change in vision. Displaying a screen on the display device means that the organic light emitting element emits light, that is, the first photon is generated, in the organic light emitting display device. Accordingly, the latency in the virtual reality display device is defined as the period from the timing when motion occurs to the timing when the first photon for displaying the video reflecting the changed motion is generated. When the latency becomes longer, the user will experience virtual reality sickness (VR sickness). That is, despite the changed vision, when the changed vision is delayed and displayed on the display device and the delay occurs continuously, the user experiences inconvenience. For another example, a change can occur in the displayed video even if the user does not take the motion. For example, a case where a change occurs in a video due to a specific event is also included in the motion.

Meanwhile, an address period (Addressing) illustrated in FIG. 4 means the period that the host system 100 provides the signals (V_Sync, H_Sync, Data Enable signal, main clock signal, etc.) for displaying a video corresponding to motion to the timing controller 170 in response to the motion occurrence, and the timing controller 170 provides the drive signals (DATA, DDC, GDC, etc.) to the data driving unit and the gate driving unit. In addition, the light-emission (Emission) period illustrated in FIG. 4 means the period that the organic light emitting element emits light. It should be understood, however, that the present disclosure is not limited to such meanings, and can also include an equivalent period.

As a result, the latency in the virtual reality display device is defined as the period from the timing when the motion occurs to the timing when the first photon is generated. That is, the latency is most preferably the address period (T_addr).

Figure 5A:
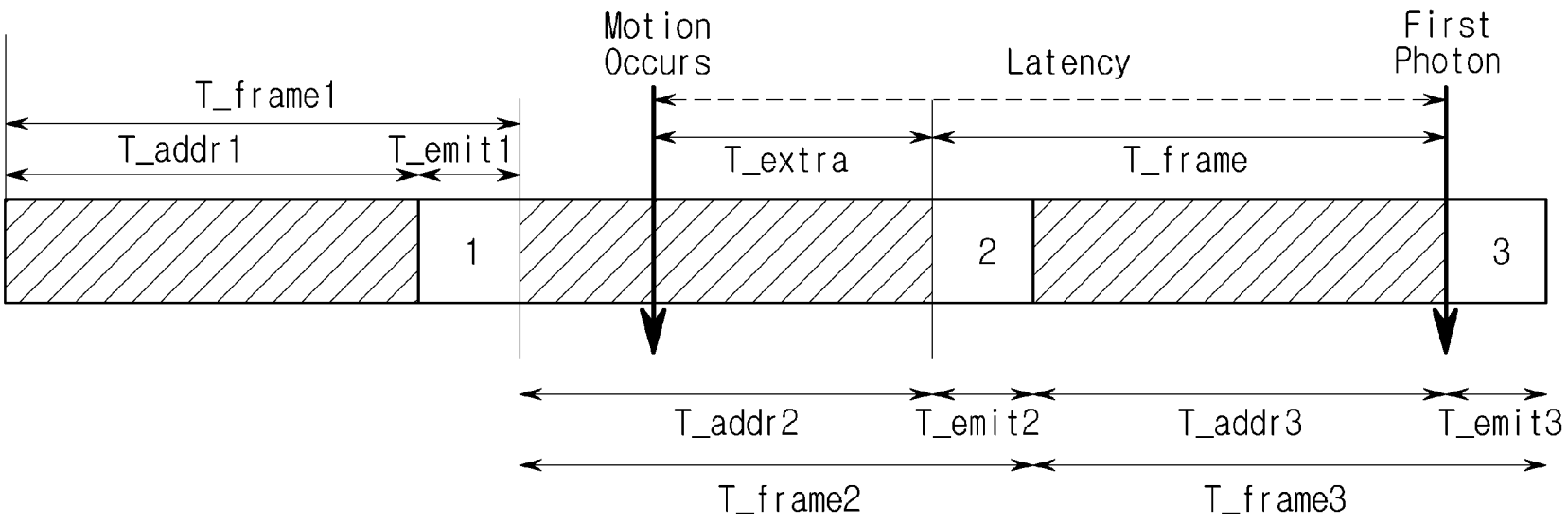
FIG. 5A is a diagram for explaining an example of the latency configuration when the motion occurs during an address period in accordance with an embodiment of the present disclosure.

FIG. 5A is a diagram for explaining an example of the latency configuration when motion occurs during the address period.

Referring to FIG. 5A, three frame periods (T_frame1, T_frame2, T_frame3) are illustrated, and each frame period includes an address period and a light-emission period. That is, the frame period 1 (T_frame1) includes an address period 1 (T_addr1) and a light-emission period 1 (T_emit1), the frame period 2 (T_frame2) includes an address period 2 (T_addr2) and a light-emission period 2 (T_emit2), and the frame period 3 (T_frame3) includes an address period 3 (T_addr3) and a light-emission period 3 (T_emit3).

For example, in a display device operating in the 120 Hz 20% global shutter mode, the frame period (T_frame) can be 8.33 ms, the address period (T_addr) can be 6.66 ms, and the light-emission period (T_emit) can be 1.67 ms.

It is assumed that motion occurs during the address period 2 (T_addr2). In this case, the light emission for displaying the video reflecting the motion can be made in the light-emission period 3 (T_emit3). As previously defined, the latency in the virtual reality display device is defined as the period from the timing when motion occurs to the timing when the first photon for displaying the video reflecting the changed motion is generated. Accordingly, the latency in FIG. 5A is T_extra+T_frame. That is, the latency in this case is T_extra+T_emit2+T_addr3.

As described above, it is most preferable that the latency is the address period (T_addr). In the example referring to FIG. 5A, the latency has been further increased by T_extra+T_emit compared to the address period (T_addr). That is, the user has taken the motion from his/her viewpoint, but will watch the video reflecting the motion later than the ideal case. Accordingly, the virtual reality sickness (VR Sickness) experienced by the user is inevitable.

Figure 5B:
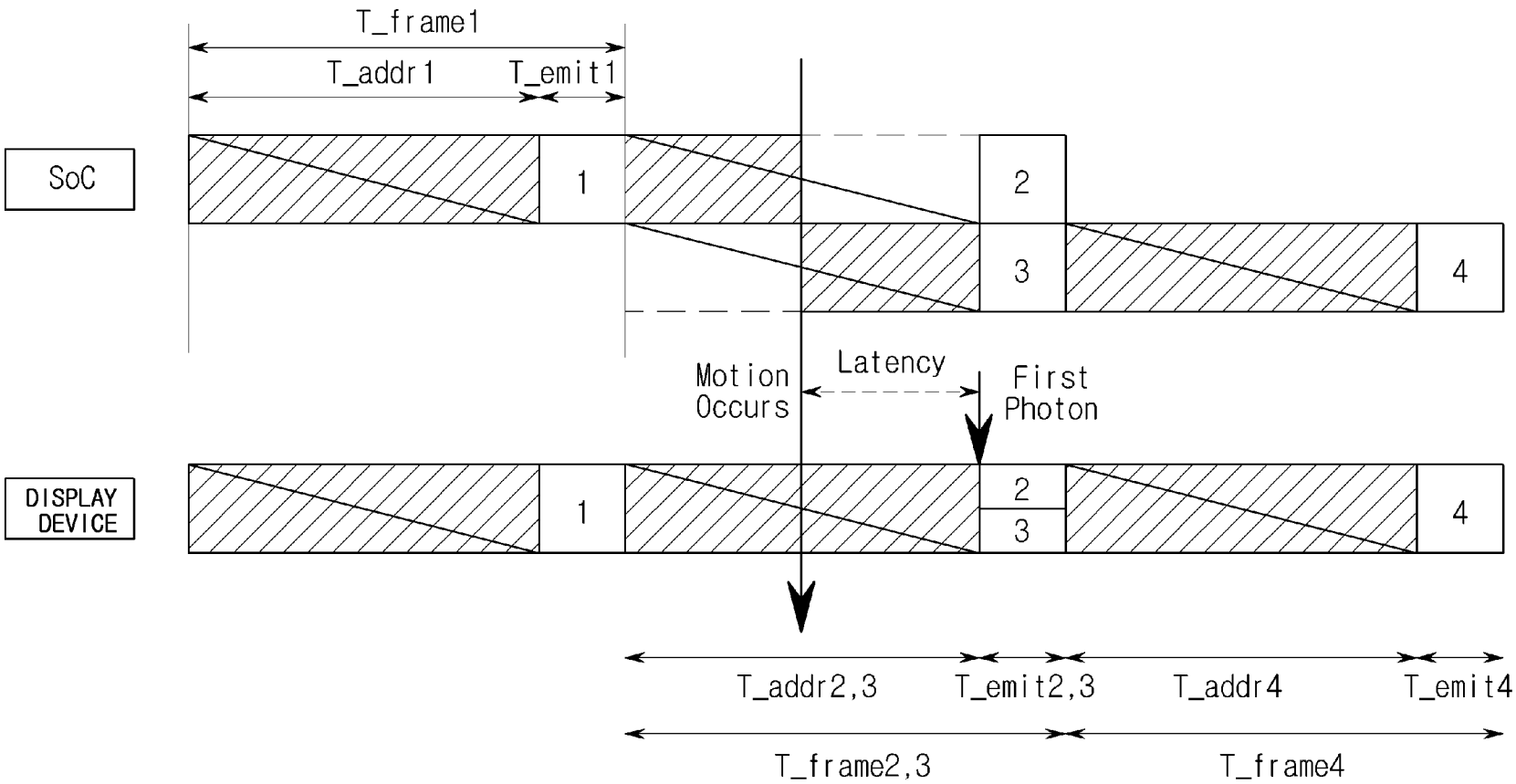
FIG. 5B is a diagram for explaining an example of the latency configuration when the motion occurs during an address period in accordance with an embodiment of the present disclosure.

FIG. 5B is a diagram for explaining the example of the latency configuration when motion occurs during the address period.

Referring to FIG. 5B, four frame periods (T_frame1, T_frame2, T_frame3, T_frame4) are illustrated, and each frame period includes an address period and a light-emission period. That is, the frame period 1 (T_frame1) includes an address period 1 (T_addr1) and a light-emission period 1 (T_emit1), the frame period 2 (T_frame2) includes an address period 2 (T_addr2) and a light-emission period 2 (T_emit2), the frame period 3 (T_frame3) includes an address period 3 (T_addr3) and a light-emission period 3 (T_emit3), and the frame period 4 (T_frame4) includes an address period 4 (T_addr4) and a light-emission period 4 (T_emit4).

For example, in a display device operating in the 120 Hz 20% global shutter mode, the frame period (T_frame) can be 8.33 ms, the address period (T_addr) can be 6.66 ms, and the light-emission period (T_emit) can be 1.67 ms.

It is assumed that motion occurs during the address period 2 (T_addr2). In this case, the SoC (included in the host system 100) processes two data within one address period. That is, the SoC processes the video data before the motion occurs and the video data reflecting the motion within one address period (T_addr2,3). That is, the video data before the motion occurs and the video data reflecting the motion are mixed and processed. A display device receiving data from the SoC generates the photon for displaying two video data (i.e., the video data before the motion occurs and the video data reflecting the motion) within one light-emission period (T_emit2,3). As previously defined, the latency in the virtual reality display device is defined as the period from the timing when the motion occurs to the timing when the first photon for displaying the video reflecting the motion is generated. Accordingly, the latency in FIG. 5B is shorter than the ideal period (T_addr).

As described above, it is most preferable that the latency is the address period (T_addr). In the example referring to FIG. 5B, the latency is further reduced compared to the address period (T_addr). That is, the user has taken the motion from his/her viewpoint and can instantly watch the video reflecting the motion. Accordingly, the virtual reality sickness (VR sickness) experienced by the user can be minimized. However, as illustrated in FIG. 5B, since the light emission (T_emit2) for the video before the motion occurs and the light emission (T_emit3) for the video reflecting the motion are simultaneously performed, the mixed video will be finally displayed simultaneously to the user.

Figure 5C:
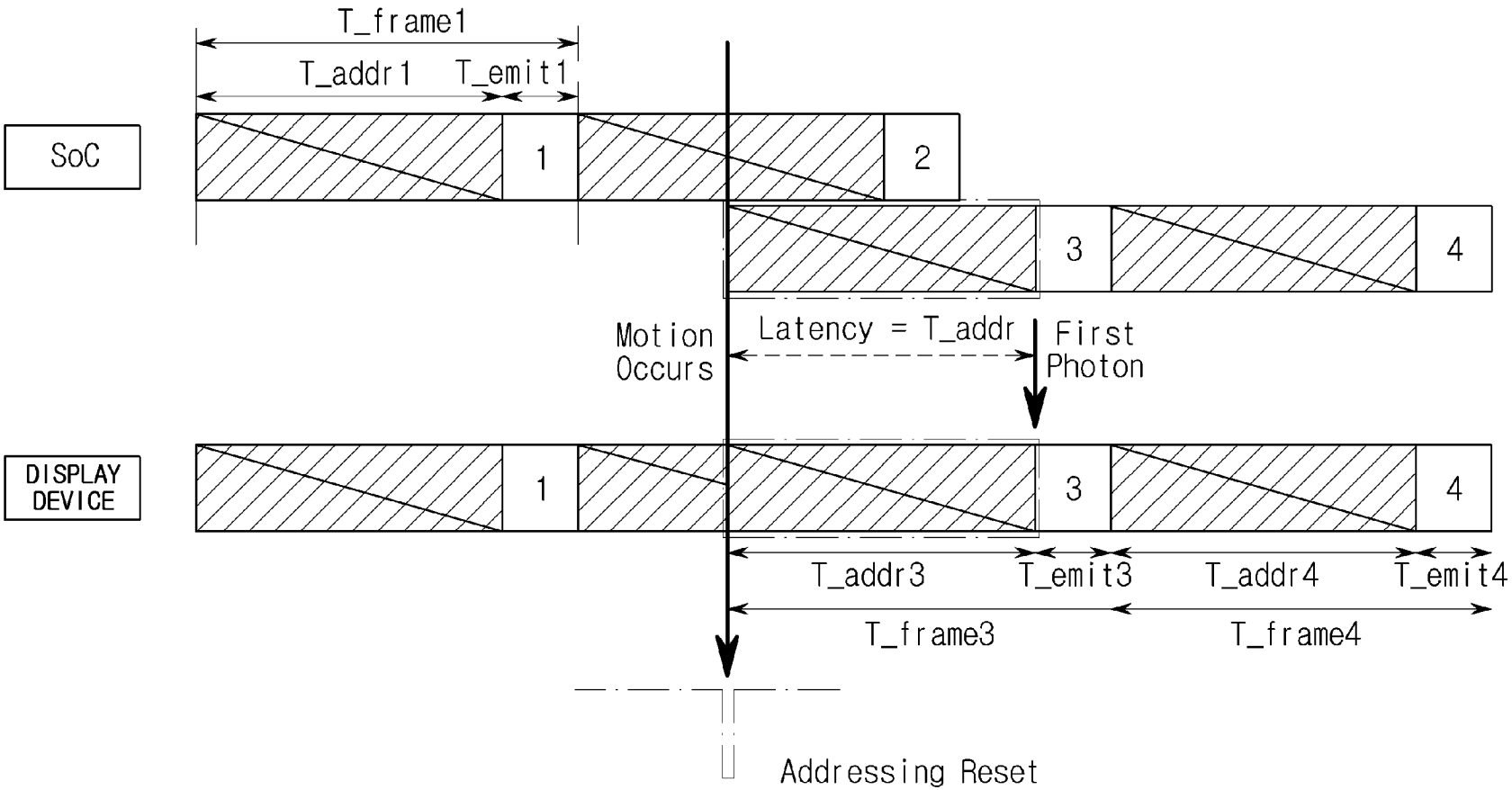
FIG. 5C is a diagram for explaining an example of the latency configuration when the motion occurs during an address period in accordance with an embodiment of the present disclosure.

FIG. 5C is a diagram for explaining the example of the latency configuration when motion occurs during the address period.

Referring to FIG. 5C, four frame periods (T_frame1, T_frame2, T_frame3, T_frame4) are illustrated, and each frame period includes an address period and a light-emission period. That is, the frame period 1 (T_frame1) includes an address period 1 (T_addr1) and a light-emission period 1 (T_emit1), the frame period 2 (T_frame2) includes an address period 2 (T_addr2) and a light-emission period 2 (T_emit2), the frame period 3 (T_frame3) includes an address period 3 (T_addr3) and a light-emission period 3 (T_emit3), and the frame period 4 (T_frame4) includes an address period 4 (T_addr4) and a light-emission period 4 (T_emit4).

For example, in a display device operating in the 120 Hz 20% global shutter mode, the frame period (T_frame) can be 8.33 ms, the address period (T_addr) can be 6.66 ms, and the light-emission period (T_emit) can be 1.67 ms.

The motion occurs during the address period 2 (T_addr2). In this case, the SoC (included in the host system 100) generates an Addressing Reset signal. In addition, the SoC processes the video data reflecting the motion. When the display device receives the addressing reset signal, the display device starts a new frame period (T_frame3). That is, the display device addresses the video data reflecting the motion within the T_addr3 period, and generates the photon for displaying the video data reflecting the motion within the T_emit3 period. As previously defined, the latency in the virtual reality display device is defined as the period from the timing when the motion occurs to the timing when the first photon for displaying the video reflecting the motion is generated. Accordingly, the latency in FIG. 5C is the same as the ideal period (T_addr).

As described above, it is most preferable that the latency is the address period (T_addr). In the example referring to FIG. 5C, the latency can become the same as the address period (T_addr). That is, the user has taken the motion from his/her viewpoint and can watch the video reflecting the motion at the most ideal timing. Accordingly, the virtual reality sickness (VR sickness) experienced by the user can be minimized.

Figure 6:
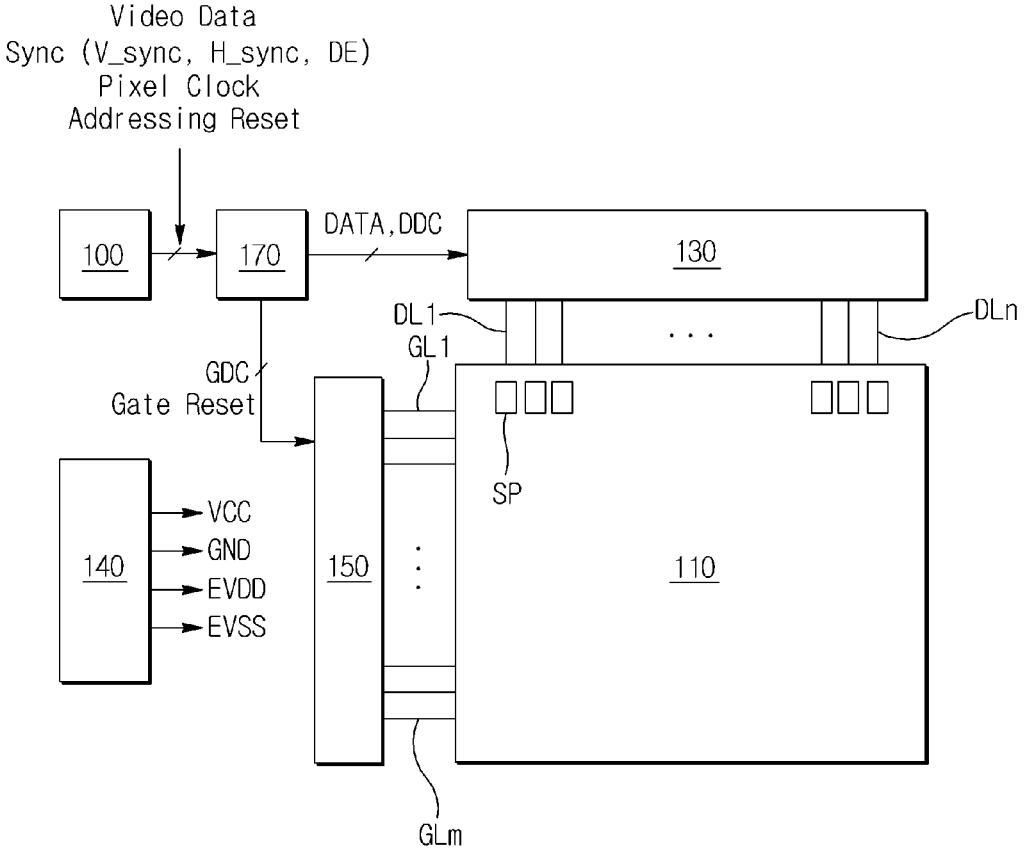
FIG. 6 is a block diagram schematically illustrating the display device for implementing an example explaining with reference to FIG. 5C in accordance with an embodiment of the present disclosure.

FIG. 6 is a block diagram schematically illustrating a display device for implementing the example described with reference to FIG. 5C.

As illustrated in FIG. 6, the display device includes the host system 100, the timing controller 170, the data driving unit 130, the power supply unit 140, the gate driving unit 150, and the display panel 110.

The host system 100 includes a system on chip (SoC) in which a scaler is built-in, and converts the digital data of the input video into a data signal of a format suitable for displaying on the display panel 110 and outputs it. The host system 100 provides various timing signals to the timing controller 170 together with the data signals.

In addition, the host system 100 provides an address reset signal (Addressing Reset) to the timing controller 170. Specifically, the address reset signal (Addressing Reset) is provided from the host system 100 to the timing controller 170 when motion occurs.

The timing controller 170 receives video data (Video Data) from the host system 100. In addition, the timing controller 170 controls the operation timing of the data driving unit 130 and the gate driving unit 150 based on the timing signals, such as a vertical sync signal (V_Sync), a horizontal sync signal (H_Sync), a data enable signal (DE), and a main clock signal (Pixel Clock) input from the host system 100.

The timing controller 170 processes as a video the data signal input from the host system 100 and supplies it to the data driving unit 130. For example, the timing controller 170 compensates the data signal input from the host system 100 and supplies it to the data driving unit 130.

In addition, the timing controller 170 receives the address reset signal (Addressing Reset) from the host system 100. Specifically, the address reset signal (Addressing Reset) is provided from the host system 100 to the timing controller 170 when motion occurs.

When the timing controller 170 receives the address reset signal (Addressing Reset) from the host system 100, the timing controller 170 provides a gate reset signal (Gate Reset) to the gate driving unit 150. In this time, the gate reset can be variously configured depending upon the type and operation of the gate driving unit. For example, it is possible to reset the gate driving unit by holding GCLK signals repeatedly input to the gate-in-panel type gate driving units in a digital low or digital high.

The data driving unit 130 performs an operation in response to the signal supplied from the timing controller 170. For example, the data driving unit 130 operates in response to the first drive signal (DDC) provided from the timing controller 170. The data driving unit 130 converts the digital data signal (DATA) provided from the timing controller 170 into an analog data signal and outputs it.

Specifically, the data driving unit 130 converts the digital data signal (DATA) into the analog data signal in response to the gamma voltage of the gamma unit provided internally or externally. The data driving unit 130 provides the data signal to the data lines (DL1 to DLn) of the display panel 110.

The gate driving unit 150 performs an operation in response to the signal supplied from the timing controller 170. For example, the gate driving unit 150 operates in response to the second drive signal (GDC) provided from the timing controller 170. The gate driving unit 150 outputs the gate signal of a gate high voltage or a gate low voltage. The gate signal can be also referred to as a scan signal.

The gate driving unit 150 sequentially outputs the gate signal in the forward direction or sequentially outputs it in the reverse direction. In addition, the gate driving unit 150 can simultaneously output the gate signal. The gate driving unit 150 provides the gate signal to the gate lines (GL1 to GLm) of the display panel 110.

When the gate driving unit 150 receives the gate reset signal (Gate Reset) from the timing controller 170, the gate driving unit 150 resets the gate drive process. As a result, the display device addresses the video data reflecting the motion (T_addr3 in FIG. 5C), and generates the photon for displaying the video reflecting the motion (T_emit3 in FIG. 5C). As a result, the latency (the period from the timing when the motion occurs to the timing when the first photon for displaying the video reflecting the motion is generated) can be maintained as T_addr, which is an ideal period. Accordingly, the user has taken the motion from his/her viewpoint and can watch the video reflecting the motion at the most ideal timing. Accordingly, the virtual reality sickness (VR Sickness) experienced by the user can be minimized.

The power supply unit 140 outputs the first voltage source (VCC, GND) for driving the data driving unit 130, etc., and the second voltage source (EVDD, EVSS) for driving the display panel 110. In addition, the power supply unit 140 generates a voltage required for driving the display device, such as a gate high voltage or a gate low voltage to be delivered to the gate driving unit 150.

The display panel 110 includes the plurality of sub-pixels (SP), the data lines (DL1 to DLn) connected to the sub-pixels (SP), and the gate lines (GL1 to GLm) connected to the sub-pixels (SP). The display panel 110 displays the video in response to the gate signal output from the gate driving unit 150 and the data signal output from the data driving unit 130. The display panel 110 includes the lower substrate and the upper substrate. The sub-pixels (SP) can be interposed between the lower substrate and the upper substrate.

Figure 7:
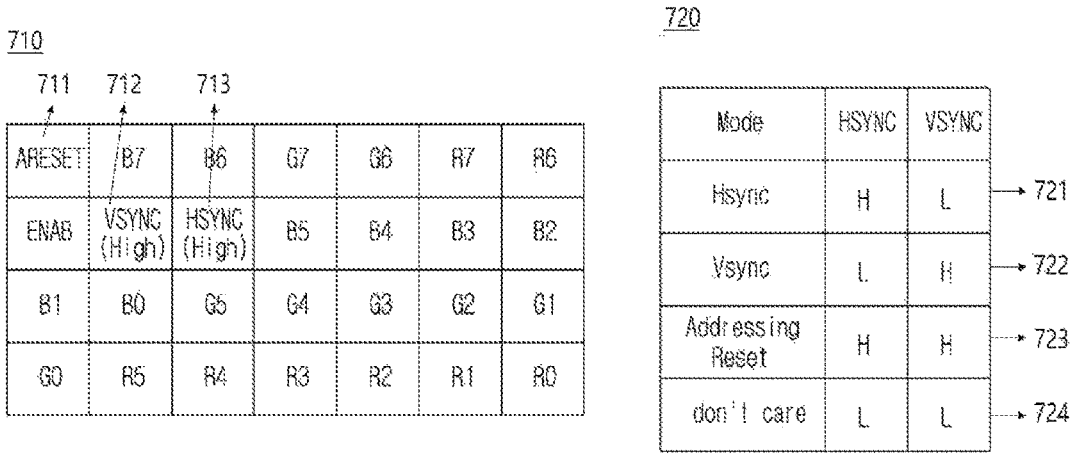
FIG. 7 is a diagram illustrating a data structure of the display device for implementing the example explaining with reference to FIG. 5C in accordance with an embodiment of the present disclosure.

FIG. 7 is a diagram illustrating a data structure of the display device for implementing the example described with reference to FIG. 5C.

Specifically, FIG. 7 is a diagram for explaining the case where the host system 100 and the timing controller 170 communicate with each other via a low voltage differential signaling (LVDS).

Referring to FIG. 7, a LVDS transmission format 710 and a LVDS recovery table 720 are illustrated.

The LVDS transmission format 710 is communicated between the host system 100 and the timing controller 170.

The LVDS transmission format 710 includes a plurality of bits. For example, R0 to R7 bits are the bits for expressing a red video, G0 to G7 bits are the bits for expressing a green video, and B0 to B7 bits are the bits for expressing a blue video. A VSYNC bit 712 is the bit for indicating a synchronization signal (Vertical Sync), and a HSYNC bit 713 is the bit for indicating a synchronization signal (Horizontal Sync).

According to the present disclosure, any one of the non-interest bits (so-called don't care bit) is assigned to the bit 711 for indicating an address reset (Addressing Reset). That is, when high is indicated in the address reset bit 711, the timing controller 170 receiving the corresponding LVDS transmission format 710 receives the command that performs the address reset. When low is indicated in the address reset bit 711, the timing controller 170 receiving the corresponding LVDS transmission format 710 receives the command that does not perform the address reset.

According to the present disclosure, the VSYNC bit 712, the HSYNC bit 713, and the recovery table 720 can be utilized. For example, when the VSYNC bit 712 is low and the HSYNC bit 713 is high in the LVDS transmission format 710, the timing controller 170 receiving the corresponding LVDS transmission format 710 receives the HSYNC synchronization command with reference to the recovery table 720 721. For example, when the VSYNC bit 712 is high and the HSYNC bit 713 is low in the LVDS transmission format 710, the timing controller 170 receiving the corresponding LVDS transmission format 710 receives the VSYNC synchronization command with reference to the recovery table 720 722. For example, when the VSYNC bit 712 is high and the HSYNC bit 713 is high in the LVDS transmission format 710, the timing controller 170 receiving the corresponding LVDS transmission format 710 receives the command that performs the address reset with reference to the recovery table 720 723. For example, when the VSYNC bit 712 is low and the HSYNC bit 713 is low in the LVDS transmission format 710, the timing controller 170 receiving the corresponding LVDS transmission format 710 receives the command that does not perform any operation with reference to the recovery table 720 724.

Figure 8:
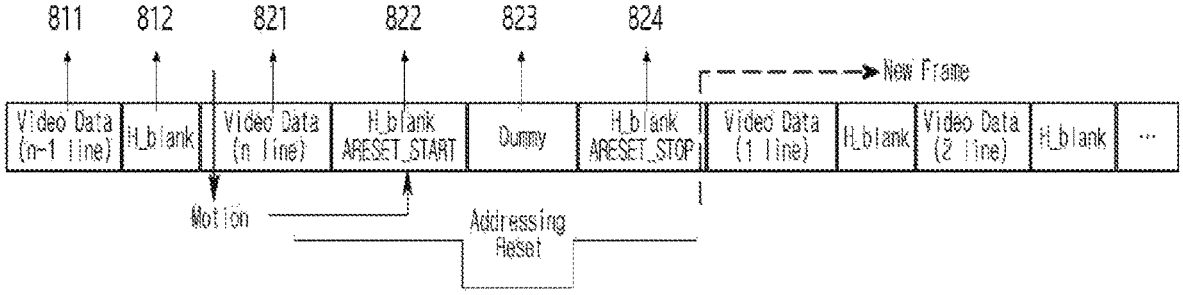
FIG. 8 is a diagram illustrating a packet structure of the display device for implementing the example explaining with reference to FIG. 5C in accordance with an embodiment of the present disclosure.

FIG. 8 is a diagram illustrating a packet structure of the display device for implementing the example described with reference to FIG. 5C.

Specifically, FIG. 8 is a diagram for explaining the case where the host system 100 and the timing controller 170 communicate with each other via a clock embedded interface.

Referring to FIG. 8, a plurality of packets transmitted and received between the host system 100 and the timing controller 170 are illustrated. For example, the plurality of packets include a video data packet 811 and a horizontal blank packet 812.

When motion occurs during the transmission of the video data packet 821, the horizontal blank packet 822 after the corresponding video data packet 821 includes the data (ARESET_START) instructing the start of the address reset. Thereafter, a dummy (Dummy) packet 823 is transmitted and then a horizontal blank packet 824 includes data (ARESET_STOP) instructing the end of the address reset. In this time, the length of the dummy packet 823 can be adjusted to control the period that the address reset proceeds.

That is, the address reset is instructed using the first horizontal blank packet 822 including the address reset start data (ARESET_START), the dummy packet 823 transmitted and received after the first horizontal blank packet 822, and the second horizontal blank packet 824 transmitted and received after the dummy packet and including the address reset end data (ARESET_STOP), and the period that the address reset proceeds can be controlled using the dummy packet 823.

Figure 9A:
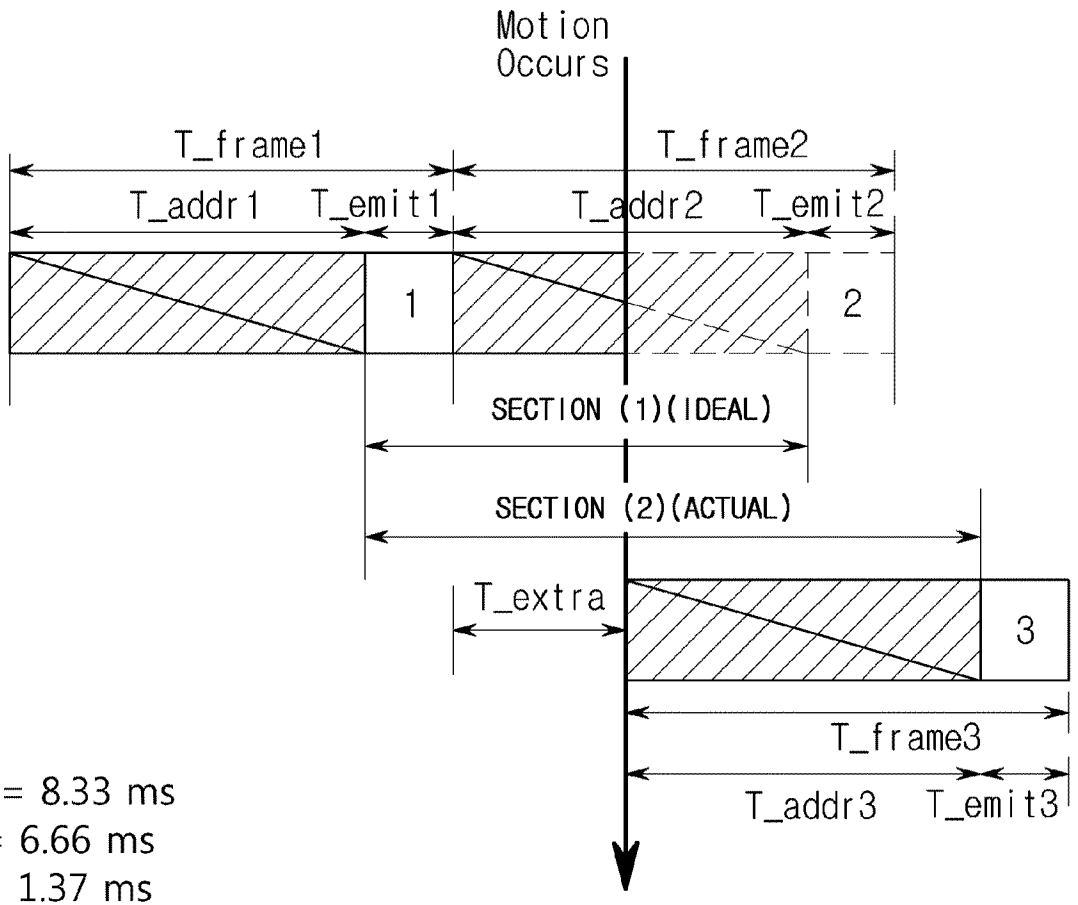
FIG. 9A is a diagram for explaining brightness compensation in implementing the latency configuration explaining with reference to FIG. 5C in accordance with an embodiment of the present disclosure.

FIG. 9A is a diagram for explaining brightness compensation in implementing the latency configuration described with reference to FIG. 5C.

For convenience of explanation, the 120 [Hz] 20% Global shutter mode will be described. It should be understood, however, that the present disclosure is merely for convenience of explanation and is not limited thereto. In the 120 [Hz] 20% Global shutter, the address period (T_addr) is 6.66 ms, the light-emission period (T_emit) is 1.67 ms, and the frame period (T_frame) is 8.33 ms.

The reason why brightness compensation is needed will be first described.

Referring to FIG. 9A, a Section 1 (Ideal) is illustrated. The Section 1 (Ideal) is the general case in which no motion occurs in the second address period (T_addr2). The period from the light emission in the first light-emission period (T_emit1) to the start of the second light-emission period (T_emit2) is T_emit1+T_addr2=8.33 ms. That is, it is the same as the frame period (T_frame). Since the period (T_emit1) that light is emitted is 1.67 ms, the brightness visually accepted by the user is regarded as the average brightness of (the light-emission period)/(the frame period). That is, (1.67 ms/8.33 ms)=0.2, such that the brightness of 20% is received. For example, when the light has been emitted with the brightness of 100 nit in the light-emission period (T_emit1), the brightness recognized by the user during the Section 1 (Ideal) is 20 nit, which is 20%.

Figure 9B:
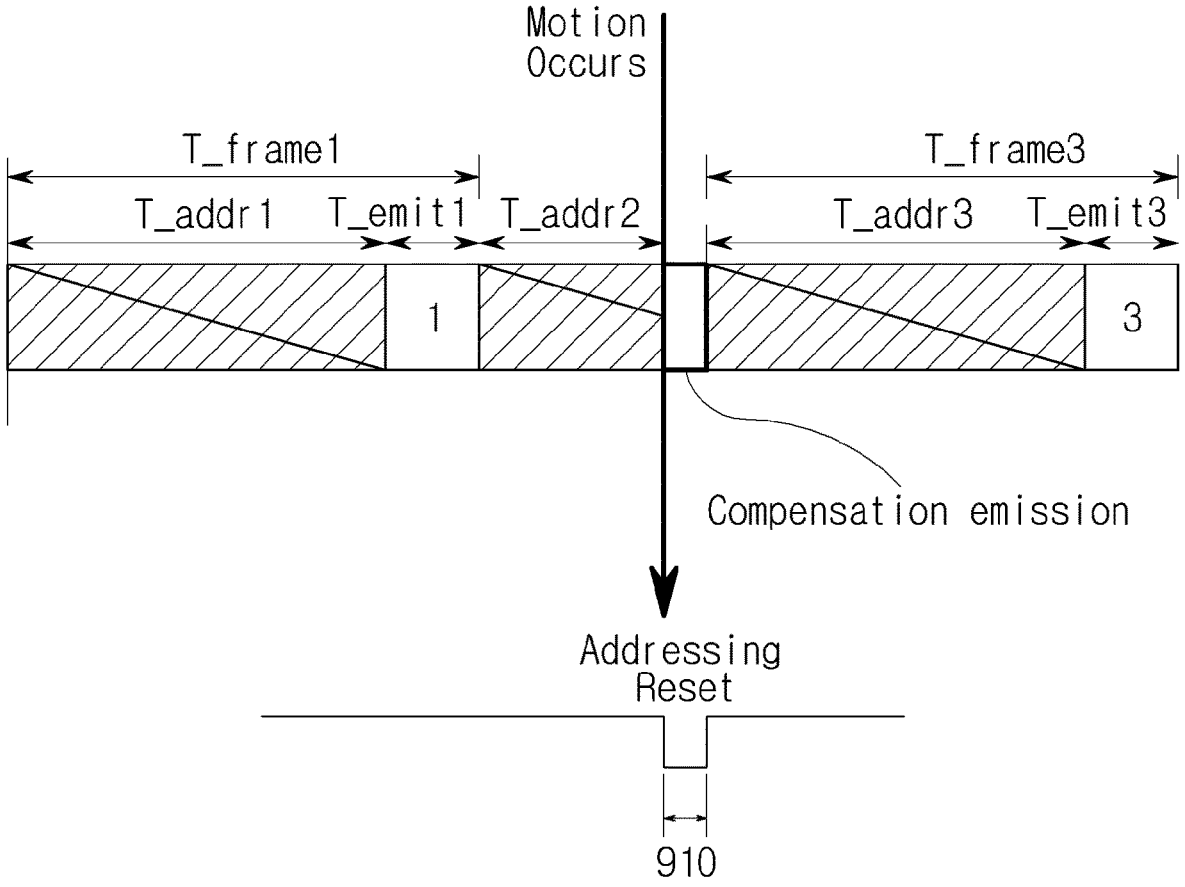
FIG. 9B is a diagram for explaining brightness compensation in implementing the latency configuration explaining with reference to FIG. 5C in accordance with an embodiment of the present disclosure.

Referring to FIG. 9B, a Section 2 (Actual) is illustrated. The Section 2 (Actual) is the case where motion occurs in the second address period (T_addr2). Herein, it is assumed that T_extra is 3.33 ms. The period (T_emit1) that the light is emitted is 1.67 ms and the period until the second light emission occurs is T_emit1+T_extra+T_addr3=11.66 ms. Accordingly, since the brightness visually accepted by the user is (1.67 ms)/(11.66 ms)=0.143, the brightness of 14.3% is received. For example, when the light has been emitted with the brightness of 100 nit in the light-emission period (T_emit1), the brightness recognized by the user during the Section 2 (Actual) is 14.3 nit, which is 14.3%.

That is, according to the latency configuration referring to FIG. 5C, the reduction in the brightness recognized by the user occurs, such that the brightness compensation of the reduced brightness is proposed.

FIG. 9B is a diagram for explaining brightness compensation in implementing the latency configuration described with reference to FIG. 5C.

In the present embodiment, it is proposed to generate compensation light-emission (Compensation Emit) for brightness compensation of reduced brightness.

Specifically, it is preferable that the compensation light-emission (Compensation Emit) occurs between after the motion occurs and before the frame (T_frame3) reflecting the motion is addressed. In the description referring to FIG. 9A, the reduced brightness is 5.7%. The compensation light-emission can be controlled to be performed by a reduced amount of brightness. Specifically, the compensation light-emission can be performed by controlling the compensation light-emission period. For example, as the amount of the reduced brightness is larger, the compensation light-emission period can be controlled to be longer. As one embodiment, the compensation light-emission period can be controlled by the pulse width 910 of the address reset signal. As another embodiment, it can be performed by controlling the brightness of the compensation light-emission. For example, as the amount of the reduced brightness is larger, the brightness of the compensation light-emission can be controlled to be larger.

The compensation light-emission can be referred to as short global emission or global compensation emission.

Due to the above-described compensation light-emission, the virtual reality sickness (VR Sickness) experienced by the user can be reduced. That is, when the compensation light-emission is not applied, the brightness deviation per a frame will be large due to the motion, and the user will experience a visual flicker. However, the brightness deviation can be reduced by the above-described compensation light-emission.

Figure 9C:
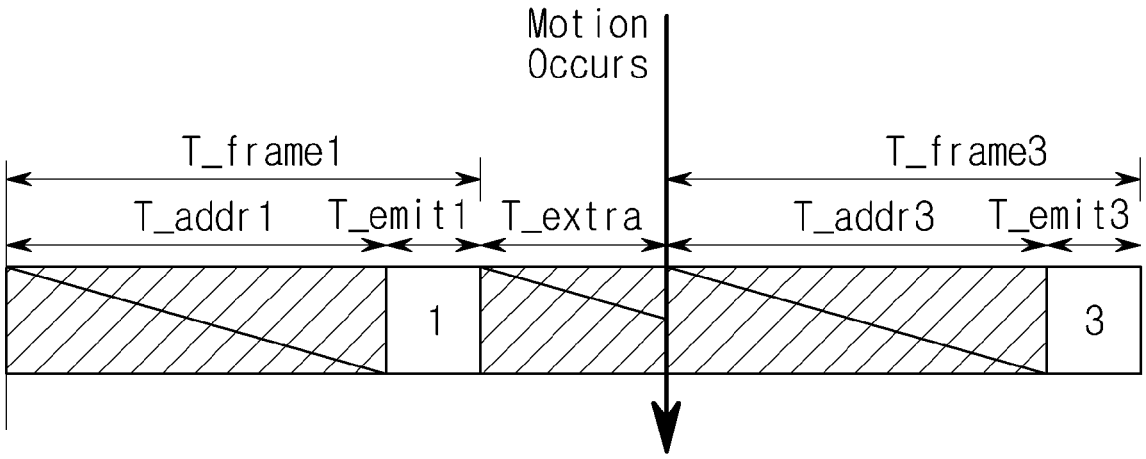
FIG. 9C is a diagram for explaining brightness compensation in implementing the latency configuration explaining with reference to FIG. 5C in accordance with an embodiment of the present disclosure.

FIG. 9C is a diagram for explaining brightness compensation in implementing the latency configuration described with reference to FIG. 5C.

In the present embodiment, it is proposed to reduce the amount of light emission for displaying video data reflecting motion for brightness compensation of reduced brightness.

Specifically, in the embodiment referring to FIG. 9A, the ideal brightness (L_ideal) is 20%, but the actual brightness (L_actual) was 14.3%, and 5.7% was reduced. In this case, when the light emission (T_emit3) for displaying video data reflecting motion is performed without compensation, the user will experience glare due to the change in a visually large brightness. Accordingly, the present embodiment proposes to reduce the amount of light emission (T_emit3) for displaying video data reflecting motion.

Specifically, the reduction rate of the amount of light emission (T_emit3) for displaying the video data reflecting motion can be as follows.

$$\text{Compensation Ratio}=(L_\text{actual})/(L_\text{ideal})$$

That is, in the embodiment referring to FIG. 9A, (L_actual)/(L_ideal)=(0.143)/(0.2)=0.715. Accordingly, the amount of light emission (T_emit3) for displaying the video data reflecting the motion can be reduced by 71.5%. For example, when it is intended to emit light of 200 nit at T_emit3, it can be controlled to emit light of 143 nit that is 71.5% in accordance with the present embodiment. For another example, when it is intended to emit light of 300 nit at T_emit3, it can be controlled to emit light of 214.5 nit in accordance with the present embodiment.

Due to the above-described reduction in the amount of light emission, the virtual reality sickness (VR Sickness) experienced by the user can be reduced. That is, when the compensation light-emission is not applied, the brightness deviation per a frame will be large due to the motion, and the user will experience a visual flicker. However, the brightness deviation can be reduced due to the above-described reduction in the amount of light emission.

As described above, although the present disclosure has been described in connection with the embodiments illustrated in the drawings, it will be understood by those skilled in the art to which the present disclosure pertains that other specific forms can be made without changing the technical spirit or essential features thereof. Accordingly, it should be understood that the above-described embodiments are illustrative in all aspects and not restrictive.

What is claimed is:

1. A display device, comprising:

a timing controller for receiving a data signal and a timing signal corresponding to a virtual reality video from a host system, the virtual reality video associated with an address period of a first frame period during which the timing controller outputs a first plurality of drive signals for displaying a first image of the virtual reality video and a light emission period during which the first image of the virtual reality video is displayed based on the first plurality of drive signals;

a data driving unit for receiving a first drive signal from the first plurality of drive signals from the timing controller during the address period, the data driving unit configured to convert the data signal based on the first drive signal;

a gate driving unit for receiving a second drive signal from the first plurality of drive signals from the timing controller during the address period, the gate driving unit configured to generate a gate signal based on the second drive signal;

a display panel having a plurality of sub-pixels and for displaying the virtual reality video; and a power supply unit for supplying power to the data driving unit, the gate driving unit, and the display panel, wherein responsive to the timing controller receiving an address reset signal from the host system when physical motion of the display device is detected during the address period of the first frame period, the timing controller is configured to stop outputting the first plurality of drive signals of the first frame period before all of the first plurality of drive signals are outputted during the address period of the first frame period, and configured to output a second plurality of drive signals for a second frame period corresponding to a second image of the virtual reality video, the second image of the virtual reality video corresponding to the motion, wherein the display panel displays the second image of the virtual reality video based on the second plurality of drive signals.

2. The display device of claim 1, wherein the timing controller transmits a gate reset signal to the gate driving unit when receiving the address reset signal.

3. The display device of claim 1, wherein the address reset signal includes an address reset bit of a Low Voltage Differential Signaling (LVDS) transmission format communicated between the host system and the timing controller, the timing controller configured to perform address reset when the address reset bit has a first value and configured not to perform the address reset when the address reset bit has a second value different from the first value.

4. The display device of claim 1, wherein the address reset signal is represented by a combination of a VSYNC bit and a HSYNC bit of a Low Voltage Differential Signaling (LVDS) transmission format communicated between the host system and the timing controller, the timing controller configured to perform address reset when the VSYNC bit and the HSYNC bit has a first combination and configured not to perform address reset when the VSYNC bit and the HSYNC bit has a second combination different from the first combination.

5. The display device of claim 1, wherein in a clock embedded interface between the host system and the timing controller, a first horizontal blank packet having an address reset start data, a dummy packet after the first horizontal blank packet, and a second horizontal blank packet having an address reset end data after the dummy packet are transmitted/received.

6. The display device of claim 5, wherein a pulse of the address reset signal is adjusted by adjusting a length of the dummy packet.

7. The display device of claim 1, wherein the timing controller transmits a compensation light-emission signal to the gate driving unit responsive to receiving the address reset signal from the host system, the gate driving unit configured to cause the display panel to emit light during a compensation light-emission period that is before an addressing period of the second frame period based on the compensation light-emission signal.

8. The display device of claim 7, wherein a duration of the compensation light-emission period is controlled by a pulse width of the address reset signal.

9. The display device of claim 7, wherein the compensation light-emission signal is controlled by a change in light-emission brightness associated with the address reset signal.

10. The display device of claim 1, wherein the gate driving unit performs a control of reducing light-emission brightness for displaying the virtual reality video corresponding to the physical motion of the display device.

11. The display device of claim 10, wherein the reduced light-emission brightness is calculated depending upon a compensation ratio; and wherein the compensation rate is calculated at a ratio between ideal brightness and actual brightness.

12. The display device of claim 1, wherein the display device is driven in a global shutter mode.

13. A display device, comprising:

a timing controller for receiving a data signal and a timing signal corresponding to a virtual reality video from a host system, the virtual reality video associated with an address period of a first frame period during which the timing controller outputs a first plurality of drive signals for displaying a first image of the virtual reality video and a light emission period during which the first image of the virtual reality video is displayed based on the first plurality of drive signals;

a data driving unit for receiving a first drive signal from the first plurality of drive signals from the timing controller during the address period, the data driving unit configured to convert the data signal based on the first drive signal;

a gate driving unit for receiving a second drive signal from the first plurality of drive signals from the timing controller during the address period, the gate driving unit configured to generate a gate signal based on the second drive signal;

a display panel having a plurality of sub-pixels and for displaying the virtual reality video; and a power supply unit for supplying power to the data driving unit, the gate driving unit, and the display panel, wherein responsive to the timing controller receiving an address reset signal from the host system when a change occurs in a video due to an event during the address period of the first frame period, the timing controller is configured to stop outputting the first plurality of drive signals of the first frame period before all of the first plurality of drive signals are outputted during the address period of the first frame period, and configured to output a second plurality of drive signals for a second frame period corresponding to a second image of the virtual reality video, the second image of the virtual reality video corresponding to the event, wherein the display panel displays the second image of the virtual reality video based on the second plurality of drive signals.

* * * * *